United States Patent [19]

Ueno et al.

[11] Patent Number: 4,571,100

[45] Date of Patent: Feb. 18, 1986

[54] ELECTRONIC TYPEWRITER

[75] Inventors: Hideo Ueno; Yuji Kurokawa, both of Nagoya, Japan

[73] Assignee: Brother Kogyo Kabushiki Kaisha, Nagoya, Japan

[21] Appl. No.: 598,440

[22] Filed: Apr. 9, 1984

[30] Foreign Application Priority Data

Apr. 26, 1983 [JP] Japan ..... 58-73488

[51] Int. Cl.[4] ..... B41J 29/26; B41J 3/12

[52] U.S. Cl. ..... 400/17; 400/62; 364/519

[58] Field of Search ..... 364/518, 519, 523; 400/545, 546, 549, 551, 553, 61, 62, 65, 120, 582, 583, 583.1, 904, 649, 16, 17, 21

[56] References Cited

U.S. PATENT DOCUMENTS

| | | | |
|---|---|---|---|
| 2,944,651 | 7/1960 | Malcolm et al. | 400/568 X |
| 3,872,959 | 3/1975 | Wang et al. | 400/65 |
| 4,140,404 | 2/1979 | Kaenel | 400/120 |
| 4,311,399 | 1/1982 | Wegryn et al. | 400/583 X |

FOREIGN PATENT DOCUMENTS

| | | | |
|---|---|---|---|
| 2356079 | 5/1974 | Fed. Rep. of Germany | 400/583 |
| 2835633 | 2/1980 | Fed. Rep. of Germany | 400/65 |
| 0108976 | 7/1982 | Japan | 400/121 |

OTHER PUBLICATIONS

IBM Tech. Disc. Bulletin, "Tapeless Carriage Control", Kerr et al, vol. 13, No. 3, Aug. 1970, pp. 657–658.

IBM Tech. Disc. Bulletin, "Adapter for Half-Line Space Control", Heath, vol. 19, No. 5, Oct. 1976, pp. 1539–1541.

IBM Tech. Disc. Bulletin, "Bidirectional Multiple-Pitch Automatic Word Underscore", Horst et al, vol. 21, No. 10, Mar. 1979, p. 3910.

IBM Tech. Disc. Bulletin, "Optimization of Underscoring and Overstriking Operations in Word-Processing Printers", Daniels et al, vol. 26, No. 8, Jan. 1984, p. 4374.

IBM Tech. Disc. Bulletin, "Printing Underscore Characters and Storing Representations Thereof", vol. 21, No. 6, Nov. 1978, pp. 2392–2393.

IBM Tech. Disc. Bulletin, "Uniform Word Underscoring in Proportionality Spaced Printer", vol. 22, No. 6, Nov. 1979, pp. 2178–2182.

*Primary Examiner*—Edgar S. Burr
*Assistant Examiner*—James R. McDaniel
*Attorney, Agent, or Firm*—Moonray Kojima

[57] ABSTRACT

An electronic typewriter has a vertical tab key for printing one continuous vertical line, extending in a plurality of printing lines. By operating the vertical tab key, a control unit detects a set paper feed amount and feeds the paper reversely to a position whereat printing of a vertical line is done, in alignment with a vertical line printed in a previous printing line, thereby to print a continuous vertical line. The paper is fed forwards by an amount less than the unit length of vertical line which can be an amount less than a unit length of the vertical line as one character, and then the vertical line is printed. Such operations are repeated so that one vertical line continues from the vertical line of the previous printing line to the present printing line.

4 Claims, 2 Drawing Figures

ELECTRONIC TYPEWRITER

BACKGROUND OF THE INVENTION

1. Field of Invention

This invention relates to electronic typewriters having a shiftable carriage mounting a printing head thereon and a paper feed device, for feeding a printing paper, based on operation of various keys arranged on a keyboard so as to perform the printing onto the paper.

2. Description of Prior Art

In prior electronic typewriters, a paper is fed so that in an in-line feed operation caused by depressing a carriage return key, a space is provided between printing lines, with characters, symbols and the like, printed thereon. Thus, disadvantageously, even if vertical lines are printed simply in the same column extending in a plurality of printing lines, a continuous long vertical line cannot be obtained, because of the space between the printing lines.

In order to eliminate such a disadvantage, the following method has been suggested in the art. First, a vertical line key on a keyboard is depressed, whereby one vertical line is printed at a desired position. Then, if necessary, desired characters, symbols and the like are key entered and printed continuously on the printing line. Next, the carriage return key is depressed to cause the paper to be fed by one printing line, and the carriage is returned to the left margin position so as to start the printing at the next printing line. Then, if necessary, desired characters, symbols and the like, are key entered and printed again. When the print head is moved to the position of the vertical line printed in the previous printing line, in order to connect the next vertical line to be printed with the previously printed vertical line, a superscript key or the like is operated, thereby to reverse feed the paper by a space which is less than the feed amount in the normal line feed operation.

The relative position between the print head and the paper is specified in the above manner, and then the vertical line key is depressed so as to print the vertical line. A subscript key or the like is operated, whereby the paper is fed in the forward direction by a space less than the feed amount in the normal feed operation, in order to connect the next printed vertical line with the previously printed vertical line. Then, the vertical line key is depressed so as to print the vertical line. In general, the carriage is shifted to the right by an amount corresponding to one character each time the printing is performed. In this state, the back space key is depressed so as to shift the carriage backwards by an amount corresponding to one character. Then, the subscript key is operated again to cause the paper feed to be performed as above.

If the paper is not fed to a position whereat the paper reverse feed is started by operating the superscript key, the short paper feed and the vertical line printing are alternately performed further as above described, thereby to cause the vertical line to be extended downwards. When the paper is fed to a position whereat the paper reverse feed is started, the vertical line key is depressed again so as to print the vertical line.

Accordingly, vertical lines extended in two printing lines do not become one continuous vertical line unless a series of key operations, such as those described above, are completed. In order to extend the vertical line further, the foregoing series of key operations must be repeated one after another. Therefore, to obtain a vertical line without a break, which may be necessary in preparing tables or the like, printing of such a line requires a complex set of operations in conventional typewriters. Thus, working efficiency is low, for example when preparing tables.

SUMMARY OF THE INVENTION

Accordingly, an object of the invention is to improve the prior art and to overcome the aforementioned and other deficiencies and disadvantages of the prior art.

Another object is to provide an electronic typewriter wherein one continous line in the vertical direction can be easily and simply printed.

A further object is to provide an electronic typewriter wherein one continuous vertical line, which is extended in a plurality of printing lines in the vertical direction, can be easily printed for example in preparing tables.

Still another object is to provide an electronic typewriter wherein a vertical tab key is operated, thereby to print one continuous vertical line from a vertical line appearing in a previous printing line and extending to a vertical line to be printed in the printing line being printed.

DESCRIPTION OF PREFERRED EMBODIMENTS

Figure 1:
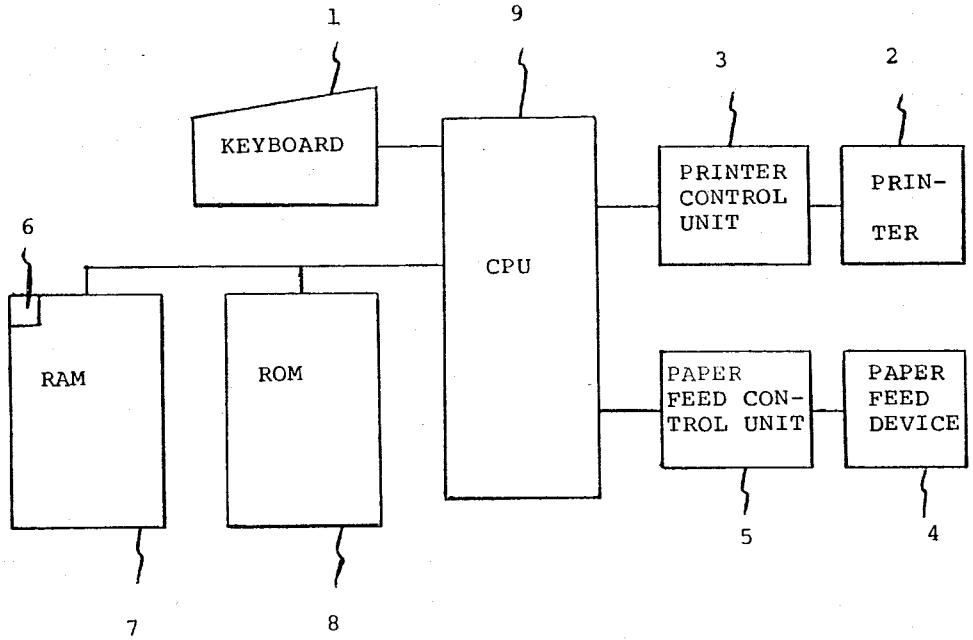
FIG. 1 is a block diagram of an illustrative embodiment of the invention.

Referring to FIG. 1, the embodiment comprises a keyboard 1, a printer control 3, a paper feed control unit 5, random access memory (RAM) 7 and a read only memory (ROM) 8, connected to a central processing unit (CPU)9, in the manner shown. On keyboard 1 are arranged various character keys, vertical tab key, various function keys for performing back space operation, carriage return operation and other functional operations, a paper feed pitch selecting switch and other switches. Printer 2 comprises a print head, such as a thermal print head, and is connected to printer control unit 3. Driving of printer 2 is controlled by printer control unit 3. Printer 2 performs printing operation by use of a thermal print head according to data entered from keyboard 1 through a thermal transferable ribbon, or the like, onto a printing paper. Paper feed device 4 is connected to paper feed control unit 5. Driving of paper feed device 4 is controlled by paper feed control unit 5, based on key entered data. RAM 7, acting as a working memory is provided with a reverse feed amount register 6 for storing reverse feed amount of the printing paper. ROM 8 stores various programs to control the above mentioned devices.

Operation of the typewriter will now be described with reference to both FIGS. 1 and 2.

In order to extend a vertical line printed in a previous printing line by depressing a vertical tab key on keyboard 1, the vertical tab key is depressed when, in the present printing line, the print head is transferred to the same column as the vertical line printed in the previous printing line. Thus, a process of extending the vertical line, for example to form a table, is started.

Figure 2:
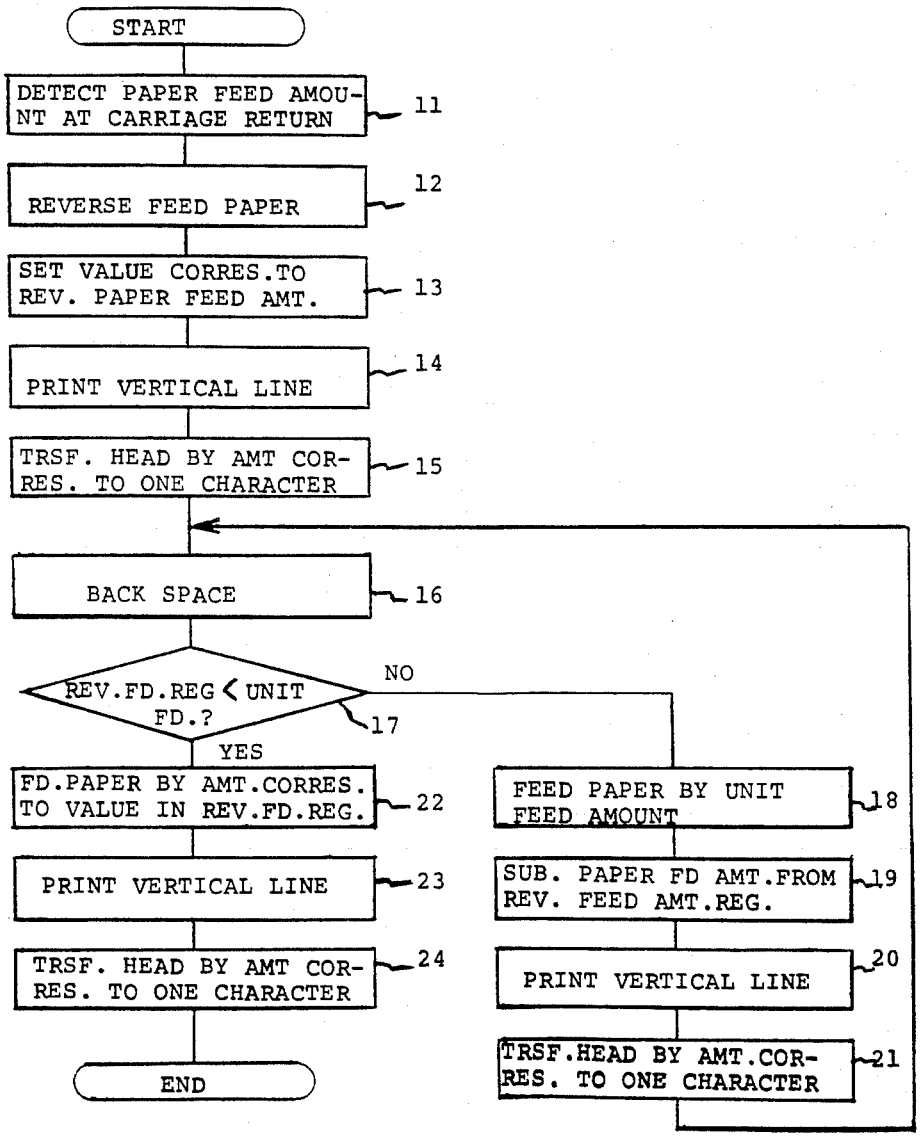
FIG. 2 is a flow chart of processing routines in operating the embodiment.

In FIG. 2, after the start, in step 11, first, the amount of paper feed at the carriage return operation, is detected by referring to a signal from a paper feed pitch selecting switch on keyboard 1. Next, at step 12, the printing paper is fed reversely by a paper feed amount, which is less than the amount detected in step 11, so that the vertical line to be printed next has continuity to the vertical line printed in the previous printing line. At step 13, a value corresponding to the amount of paper reverse feed existing at step 12, is set into the reverse feed amount register 6, in RAM 7. Next, at step 14, a vertical line is printed. At step 15, the print head is transferred in the character feed direction by an amount corresponding to one character. At step 16, back space operation is performed once so as to return the print head by an amount corresponding to one character.

At step 17, determination is made whether or not the value in the reverse feed amount register 6 is less than a unit feed amount, that is, whether a definite paper feed amount is set which is less than the unit length of the vertical line, as one character, so that the vertical lines are printed in contact with each other in the column, and the extension of the vertical line is carried out.

If the value in the reverse feed amount register 6 is equal to or more than the table formation feed amount (i.e. NO), at step 18, the paper is fed by the unit feed amount. At step 19, the amount of paper feed at step 18 is subtracted from the reverse feed amount register 6. At step 20, a vertical line is printed. At step 21, the print head is transferred in the character feed direction by an amount corresponding to one character. Then, the process is returned to step 16.

On the other hand, at step 17, if the value in the reverse feed amount register 6 is less than the unit feed amount (i.e. YES), at step 22, the paper is fed by an amount corresponding to the value in the reverse feed amount register 6. A step 23, a vertical line is printed. At step 24, the printing head is transferred in the character feed direction by an amount corresponding to one character. Then, the process is ended.

Although a thermal head is shown and discussed as the printing head, other types of printing heads can be used, such as the impact type, jetting ink type, etc., with suitable printing paper used therewith.

Advantageously, according to the invention, vertical lines, which are otherwise normally separated on account of the space provided by the line feed operation using conventional normal carriage return between printing lines, appearing in the previous printing line and the present printing lines, may be obtained in one continuous vertical line.

Furthermore, in the embodiment, ink from the thermal transferable ribbon, is transferred to the printing paper, using the thermal head, thereby to perform printing. In order to separate the ink portion of the thermal ribbon from being transferred from the paper, the print head should be moved after printing of each character. When, using an impact type head, transfer of the head after printing of each character is not necessary. Also, since transfer of the head after each print operation is not necessary, no back spacing is necessary.

The foregoing description is illustrative of the principles of the invention. Numerous modifications and extensions thereof would be apparent to the worker skilled in the art. All such modifications and extensions are to be considered to be within the spirit and scope of the invention.

What is claimed is:

1. An electronic typewriter, in which one continuous vertical line can be printed extending across a plurality of horizontal printing lines, said typewriter comprising a printer for performing a printing operation using a print head which is shiftable along a printing line of a printing paper;

a keyboard having a number of character keys, various function keys, including a vertical tab key for generating a vertical tab signal, and various selecting switches arranged thereon; means to enable a continuous vertical line to be printed in response to the actuation of only one key including means to enable said printer to print a unit length of a vertical line, in response to said vertical tab signal, said unit length of said vertical line being sufficient to form a continuous vertical line when two or more vertical lines of unit lengths in adjoining printing lines are printed on adjacent lines and in vertical alignment;

a paper feed device for feeding said printing paper forwards and backwards, in a direction perpendicular to said printing line of said printing paper; and means for controlling said printer and said paper feed device, responsive to data entered from said keyboard, said means for controlling comprising means for detecting the amount of paper fed between a previous printing line and a present printing line, in response to a vertical tab signal being entered from said keyboard;

first means for controlling said paper feed device to feed said paper reversely so as to connect a vertical line printed in said previous printing line with a next printed vertical line by superimposing the lower end of said vertical line in said previous printing line and the upper one end of said next printed vertical line;

a register for storing a paper feed amount fed by said first controlling means, said paper feed amount being less than said feed amount of said paper detected by said detecting means;

second means for controlling said paper feed device to feed said paper forwards by a unit feed amount less than said unit length of said vertical line, in case the value in said register is equal to or more than said unit feed amount;

means for subtracting said unit feed amount from said value in said register each time said paper is fed forwards by said unit feed amount;

said second controlling means controlling said paper feed device to feed said paper by a feed amount corresponding to a remaining value in said register upon said subtracting operation of said means for restoring said paper to said present printing line, in case said value in said register is less than said unit feed amount; and third means for controlling said printer to print said unit length of a vertical line each time said paper is fed when said vertical tab signal is entered from said keyboard, whereby one continuous vertical line is printed from said previous printing line to said present printing line without breaks or protrusions and the terminal end of the printed vertical line is aligned at the exact position of said present printing line.

2. The typewriter of claim 1, wherein said unit feed amount of said feeding means is a subscript amount.

3. The typewriter of claim 1, wherein said print head is a thermal head.

4. The typewriter of claim 1, wherein said detecting means detects setting position of a switch for selecting a paper feed pitch arranged on said keyboard.

* * * * *